US005857375A

United States Patent [19]

Nelson et al.

[11] Patent Number: 5,857,375

[45] Date of Patent: Jan. 12, 1999

[54] CAN END STRIPPER AND PART EJECTOR

[75] Inventors: Donald Nelson; Gary V. Ruby, both of Cockeysville, Md.

[73] Assignee: M. S. Willett, Inc., Cockeysville, Md.

[21] Appl. No.: 455,651

[22] Filed: May 31, 1995

[51] Int. Cl.[6] ..... B21D 22/00; B21D 45/00

[52] U.S. Cl. ..... 72/361; 72/344; 72/427

[58] Field of Search ..... 72/361, 344, 345, 72/419, 427, 19.4, 18.5, 346, 354.6, 350, 362; 406/88

[56] References Cited

U.S. PATENT DOCUMENTS

| | | | |
|---|---|---|---|
| 3,395,562 | 8/1968 | Bushi | 72/350 |
| 3,425,257 | 2/1969 | Heiser | 72/350 |
| 4,164,860 | 8/1979 | Kaminskas | 72/345 |
| 4,364,255 | 12/1982 | Byrd | 72/345 |
| 4,554,814 | 11/1985 | Grow et al. | 72/345 |
| 4,696,179 | 9/1987 | Cook et al. | 72/405 |
| 4,741,196 | 5/1988 | Stewart et al. | 72/427 |
| 4,934,230 | 6/1990 | Wallis | 72/427 |
| 4,958,008 | 9/1990 | McQuilkin | 72/427 |
| 5,331,836 | 7/1994 | Cudzik | 72/346 |

*Primary Examiner*—Lowell A. Larson
*Assistant Examiner*—Rodney Butler
*Attorney, Agent, or Firm*—James Creighton Wray; Meera P. Narasimhan

[57] ABSTRACT

Can ends are ejected from a tool station by a lifter ring and air currents in an ejector chute provided by a curved nozzle assembly adjacent an opening in the lower edge of the chute. It entrains can ends in air current across the die station and over a knife edge in the lower opening of the chute. The lower wall of the chute is positioned on top of the blanking die during the can end entrainment. The punch assembly moves down through the lower opening and through a larger opening in the chute. After can end clears the tooling and continues down the chute with air streams that are augmented by nozzles in the upper wall, the chute is lifted. Double-acting cylinder actuators lift the chute. Side walls of the chute taper inwardly to align the can ends for precise release from the discharge end. Sensor emitters sense passage of the can ends. Solenoid valves control application of fluid pressure to opposite ends of the actuator cylinders. A solenoid valve controls a booster current air blast for starting can covers along the chute. Lifting and lowering the chute a stall amount provides rapid and accurate indexing and stepping of the sheet material to the die stations. The chutes being in sections allows for their side by side aligning over the tooling stations and quick removal of the assembly. Lifting and lowering of the chutes/stripper combination by means other than press slide allows independent timing from the press. Lowering the chute/stripper combination allows can ends to eject from the top of the lower die surface unobstructed by the stripper.

10 Claims, 5 Drawing Sheets

CAN END STRIPPER AND PART EJECTOR

BACKGROUND OF THE INVENTION

This invention relates to stripper ejectors for high speed multiple can end forming tooling.

In forming tooling, a need exists for precise and rapid removal of can ends from the die station, and precise discharging of the can ends for accumulation in a stack to be transferred to a place of use for applying to can bodies.

Needs have long existed for stripper chutes which aid the function of the press, which do not slow operations, and which do not jam and stop operations. The present invention solves those long standing needs. The present device provides for removal of the end without the need for inclined bed presses to facilitate part removal. The press bed can be level and the finished end remains on the surface of the lower die ring for ejection.

SUMMARY OF THE INVENTION

The invention provides a combination stripper/chute for removing formed can ends from die assemblies. The stripper/chute is embodied in a five-out, staggered die arrangement. Each upper punch assembly and die assembly have blanking tools for punching a can end from a coil of sheet metal. The material extends above the lower die assemblies and below the exit chutes and upper die assemblies. The stripper/chutes move down, trapping the material. The upper punch assemblies are lowered, meet, and move into the assemblies, blanking and forming the ends. Once the ends are formed, the upper assemblies move away from the lower assemblies, disengaging the formed ends. Lift ring knockouts in the lower assemblies positioned under the ends push the formed ends upward. Accurate groups of high pressure air nozzles positioned adjacent to sides of the formed ends deliver a timed pulse of high pressured air to side edges of the ends, clearing the ends from the lower dies to enter part exit chutes. The chutes move up to their original positions for stock feeding and the process is repeated. Tubes connected to air sources and extended across tops of the chutes deliver a timed flow of air directed downward and toward the chute exits. That flow of air assists in the movement of the ends through the chutes.

The high pressure air nozzle assemblies extend from air tubes that are connected to air solenoid valves. The tubes extending along the upper walls of the chutes receive air supplied from a separate air source. That allows for timed air flow in the chutes and to part ejection nozzles.

Can ends are lifted from the lower tooling station by a lifter ring, ready for ejection. The air ejection is provided by a curved nozzle assembly adjacent an opening in the front lower edge of the chute, which ejects the can end in the air current produced across the lower die station and over a knife edge in the lower opening of the chute. The lower wall of the chute is positioned (clamped) on the top of the material during the can end ejection through the chute. The chute being clamped onto the material on the blanking die provides for an unobstructed path for ejection of the end into the chute. A knife edge is provided to allow for smooth transition of the end to the top surface of the lower chute. The punch assembly moves through the lower opening in the lower wall of the chute and through a larger opening in the upper wall of the chute. After the can end clears the tooling and continues down the chute, air streams that are augmented by nozzles in the upper wall which are directed rearward and downward, and the chute is lifted. Lifting the chute is accomplished by four solenoid actuated cylinder actuators, two at each end of the chute assembly. The actuators drive posts upward through linear bearings in guides and lift and lower rails to which the chute end mounts and the chute are attached. The side walls of the chute taper inwardly to align the can ends for precise release from the discharge end. The passage of the can ends is sensed by photoelectric controls using the emitter to project a beam through a vertically aligned opening in the lower and upper walls of the chute, which beams are sensed by receivers on the top of the chute. A solenoid valve controls a booster current of air blast when useful for starting can covers along the chute. Lifting and lowering the chute a small amount allows rapid and accurate indexing and feeding of the material to the tooling stations, assists holding the sheet material when the chute is lowered and allows unobstructed end ejection an lowered position. The construction of the chutes in sections allows side by side aligning of the chutes over the tooling stations and quick removal of the stripper/chute assembly by station to obtain access to each tool. Lifting and lowering of the chutes/stripper combination by means other than press slide allows independent timing from the press. This allows material feeding to be delayed until part ejection. Lowering the chute/stripper combination allows can ends to eject from the top of the lower die surface unobstructed by the stripper. A fixed chute or stripper raised sufficient for feeding material will obstruct ejection as the end must lift up to the level of the chute for ejection. End ejection from the surface of the lower tool provides more time for ejection than methods that retain the end in the upper tooling (required to raise end to chute level) and knockout the end from the upper tool at the top of the stroke. The end must then clear the tooling, be detected and stop the press prior to tool contact. The present device provides double the time for ejection, can be used on non-inclined presses, has multiple stations of tools, provides easy tool access and allows for means of end ejection for tooling where the end cannot be retained, lifted and knocked out of upper dies.

Can end ejection apparatus includes a chute having upper and lower walls. First and second opposite side walls are connected to the upper and lower walls. An opening in the upper wall receives a punch and an opening in the lower wall surrounds a die. The first and second side walls are inwardly tapered beginning at the openings and then are generally parallel to a discharge end of the chute. An air supply is connected to the chute, and directional air outlets are connected to the upper wall of the chute between the openings and the discharge end. An air nozzle is connected to the chute upstream of the openings and adjacent the openings for ejecting formed can ends across the opening and downstream in the chute through the discharge end. A secondary pressurized air supply is connected to the air nozzle for supplying periodic increased flow from the air nozzle. A photoelectric sensor is connected to the upper wall downstream of the openings for sensing can ends passing down the chute and clear of tooling. A second sensor is positioned beneath a lower wall of the chute for cooperating with the first sensor in sensing passage of ends. The air supply to the nozzle is turned off by a control upon the can end passing the sensor to conserve air usage. Head end and discharge end mounting blocks are respectively attached to head and discharge ends of the chute. First and second stripper bases are anchored at opposite ends of the chute. First and second guides are respectively connected to the bases beneath the head and discharge mounting blocks. Cylinder actuators are connected to the bases, and stripper guide posts are connected to the cylinder actuators and are connected to the mounts for raising and lowering the mounts and the chutes. Linear bearings are mounted in the guides surrounding the guide posts for guiding the guide posts. Stripper support rails are connected to the mounts for interconnecting the mounts and are connected to the chute for supporting the chute. Lower guide rails are connected to the stripper guides for supporting the guides and for supporting the support rails.

A can end ejector chute apparatus includes first and second chute bases respectively mounted in front of and in back of a press. Chute guides are mounted on the bases, and vertically aligned linear bearings are mounted in the chute guides guide rails extending across the press bed and interconnecting the first and second guides on the first and second bases. Double-acting cylinder actuators are mounted on the bases, and posts are connected to the actuators and extend through the linear bearings in the guides. Solenoid valves are connected to the double-acting cylinder actuators. An air source is connected to the solenoid valve, and supply lines are connected between the solenoid valve and ends of the double-acting cylinders. An electrical control is connected to the solenoid valve for selectively controlling fluid from the source through the valve to the actuators to selectively raise and lower the actuators and the posts. First and second chute mounts are connected to the posts for moving vertically with the posts. Chute rails are connected to the chute mounts and extend parallel to the guide rails for raising and lowering with the posts. A chute is connected to the chute mounts. The chute has an upper wall, a lower wall and first and second side walls. The upper and lower walls having aligned openings for receiving a reciprocating punch moving cooperatively with a die assembly positioned between the opening in the lower wall. Air nozzles are connected to the chute for supplying air downward and rearward toward a discharge end of the chute for entraining can ends along the chute.

The ejector chute apparatus includes a nozzle positioned adjacent the opening in the lower wall on a side opposite the discharge opening of the chute for directing a curtain of air across the opening in the lower wall of the chute and across the die assembly toward the discharge end of the chute.

The ejector chute apparatus further includes a source of high pressure air, a solenoid valve connected to the source of high pressure air and having an output connected to the nozzle. A control is connected to the solenoid valve for opening the solenoid valve and delivering high pressure air to the nozzle for starting movement of a can cover end across the opening in the lower wall, across the die assembly and beyond the sensor in the chute, turning off the air nozzle.

A method of ejecting can ends from upper and lower dies includes advancing a sheet of material, lowering a chute into contact with the sheet to clamp the sheet, closing the dies, punching a blank from the sheet, forming a can end from the blank near an opening in a chute, opening the dies, blowing the can end into and along the chute, raising the chute and repeating the steps.

The method of ejecting can ends further includes lifting the formed can end from the lower dies before the ejection. The ejection includes directing air in a parallel stream from a nozzle adjacent the opening. The ejection further includes directing air streams rearward and downward into the chute from multiple nozzles at the top of the chute.

The method of ejecting can ends further includes sensing can ends passing through the chute. The sensing includes emitting a beam below the chute, sending the beam through aligned openings in a bottom and top of the chute, and detecting the beam and interruptions of the beam at the top of the chute.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
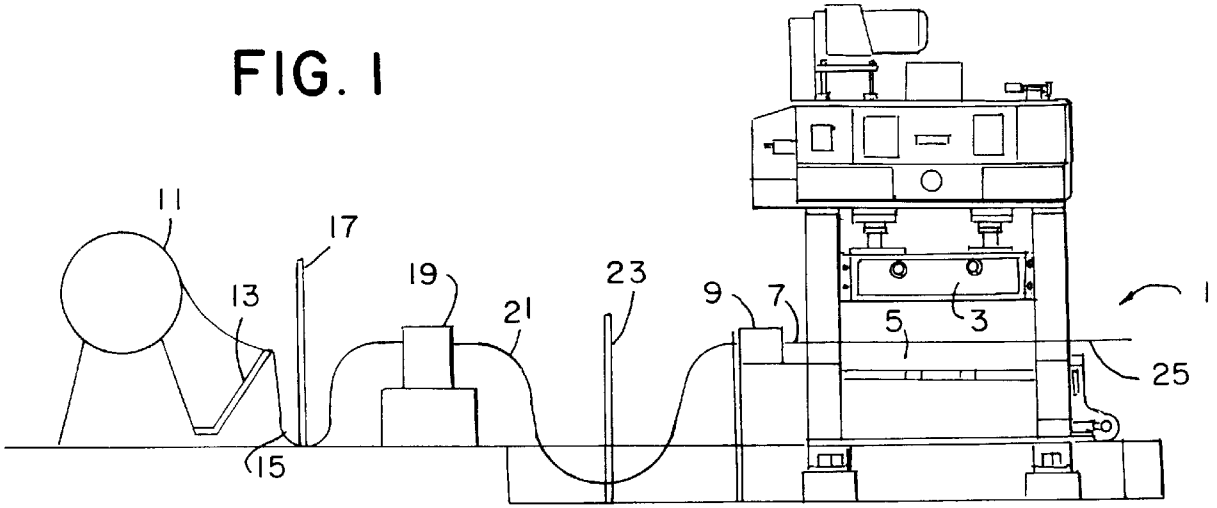
FIG. 1 shows the unrolling, controlling, leveling and feeding of the material into a press.
Figure 2:
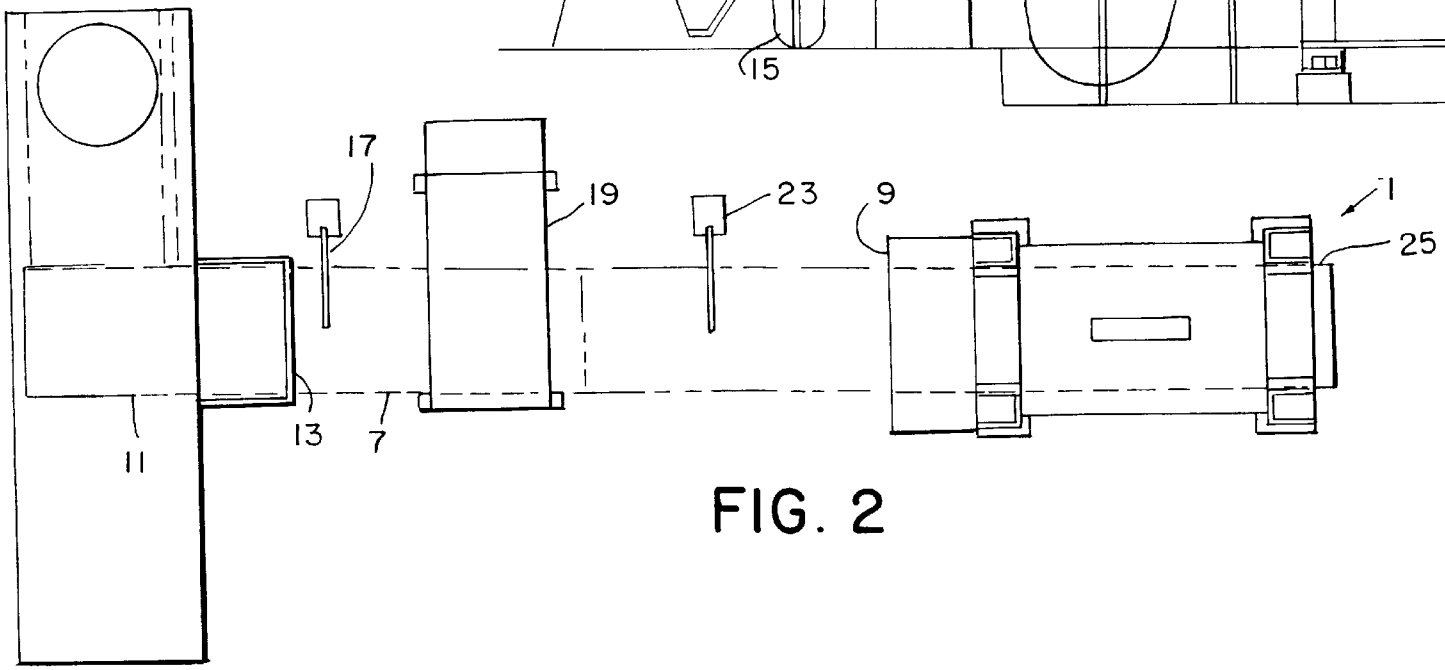
FIG. 2 is a plan view of the apparatus shown in FIG. 1.

Referring to FIGS. 1 and 2, a press 1 has a moving head with a punch assembly 3 and a base with a die assembly 5. A sheet of material 7 is advanced through the press by a periodic feed mechanism 9. Sheet 7 is unrolled from a roll 11 past a control loop catenary 13 into a straightening loop 15, which is controlled with a sonic loop control 17. The sheet 7 may pass directly into the cam feed 9. Alternatively, as shown in FIGS. 1 and 2, the sheet 7 passes through a leveller 19 and through a second loop 21 controlled by a sonic loop controller 23.

As shown in FIGS. 1 and 2, the sheet material enters the left side of the press, and scrap 25 exits the right side of the press.

Figure 4:
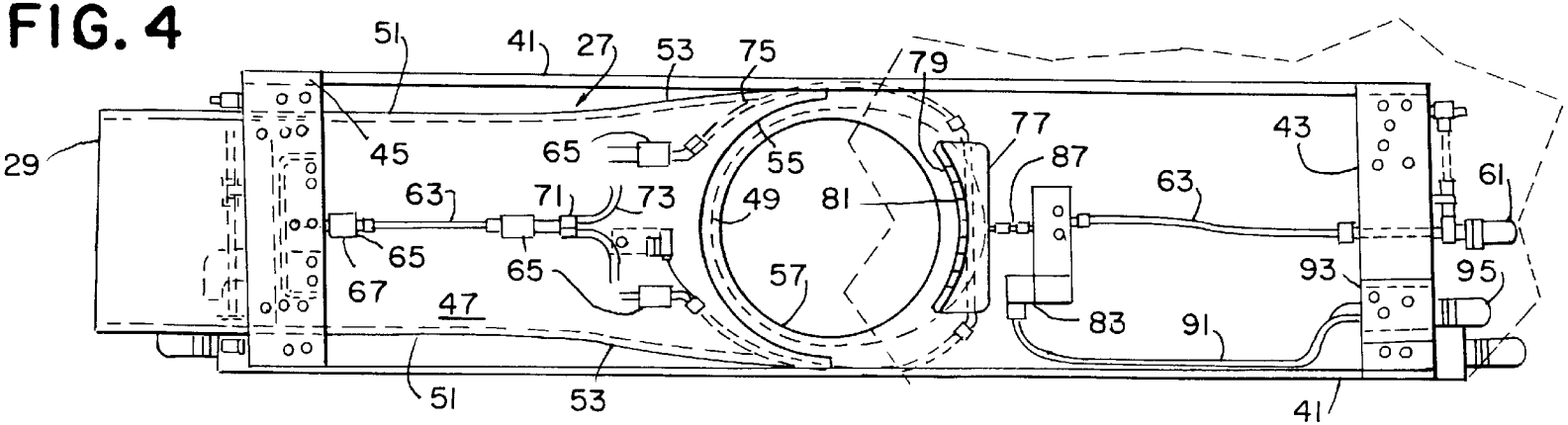
FIG. 4 is a plan view of the chute shown in FIG. 3.

Referring to FIG. 4, the left side of the press is shown. The press may have several identical punch and die assemblies 3 and 5. Plural chutes 27 are mounted adjacent the press to move finished parts down the chutes and out of the discharge ends 29. Several chutes may be mounted side by side for servicing individual opposed punch and die assemblies within the press so that a single sheet 7 fed into the press may produce multiple parts at the same time.

The chutes are supported on bases 31, which support guides 33. Actuators 35 are mounted on the bases 31 to move support posts 37 vertically to raise and lower the chute. Guides 33 are connected by lower rails 39, which extend through the press bed and which interconnect the guides at the front and rear of the press.

Immediately above the rails 39 are upper rails 41, which reciprocate upward and downward with the chutes. Rails 41 are connected between the head end mounting block 43 and the discharge end chute mounting block 45 for supporting the chute and the related reciprocating structure.

Figure 3:
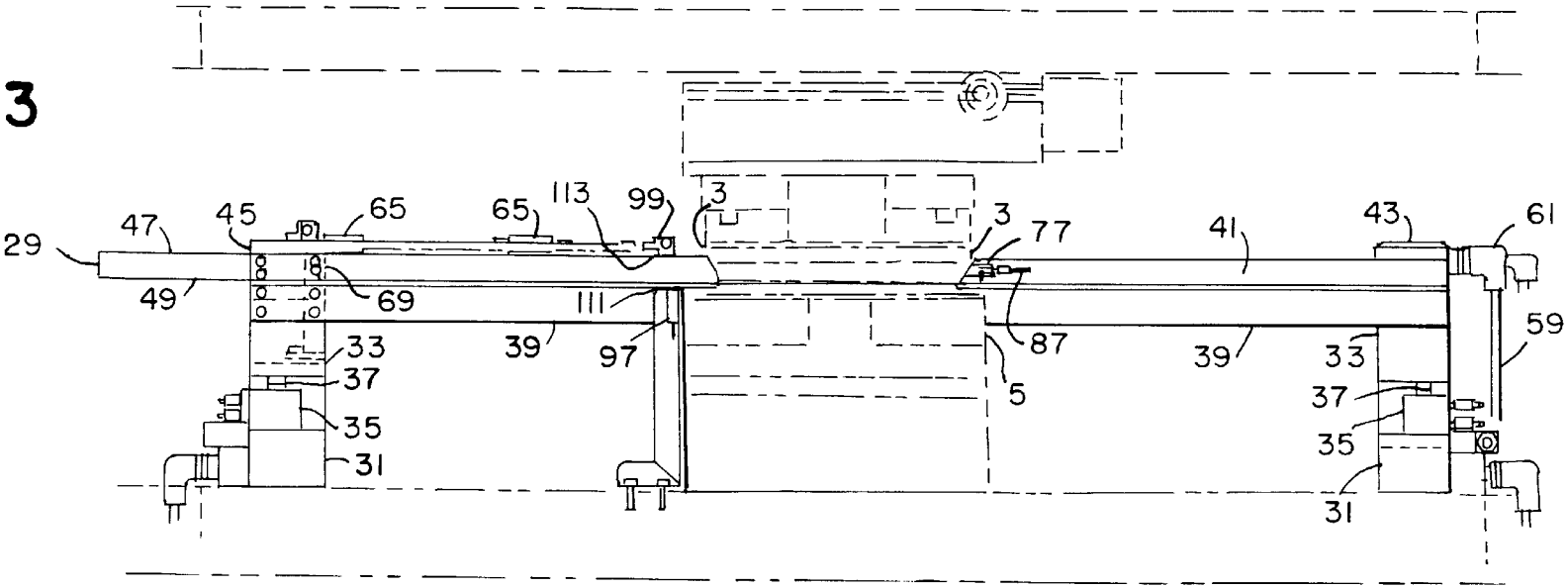
FIG. 3 is a side elevation of a movable stripper/chute and supports for removing completed can ends from the press. The press is shown in phantom lines in a view taken from the right side of the press, showing the discharging of can ends at the rear of the press.

The chute 27 has a top wall 47 and a bottom wall 49, as shown in FIG. 3, and first and second opposite side walls 51, as shown in FIG. 4. The opposite side walls 51 have converging portions 53, which lead from the opening 55 in the upper wall which is nearer the circular opening 57 in the lower wall. Openings 55 and 57 are aligned to permit the passage of the punch 3, as shown in FIG. 3.

High pressure air service line 59, as shown in FIG. 3 is connected by a connector elbow 61 for providing a source of pressure to air service line 63 mounted on top of the upper surface 49 of the chute 47. Also mounted on the top of the upper surface 49 of the chute 47 are nozzle assemblies 65 with openings 67 to jet air 69 downward in the chute and rearward toward the discharge end 29 to speed the can ends along the chute and out the discharge end. Four such nozzle assemblies 65 are provided. Two are connected to the Y connector 71 through branches 73, which lead into two circular branches of 75 and are supplied with air by nozzle assembly 77. The starter nozzle assembly has a curved array 79 of nozzles 81, which direct air rearward in streams over a wide area, forming a curtain which starts the movement of the can ends along the path toward the discharge end 29.

Air power is provided by solenoid control valve 83 which permits air pressure from line 63 to connect to outport 87 for pulsing high pressure air from source connector 61 through the nozzle openings 81 and 65.

Wires 91, wire boxes 93 and connectors 95 provide reactive operations for the part chute.

As shown in the side elevation of FIG. 3, sensors have sources 97 and receivers 99 for determining the flow of can ends through the chute 27.

In a multiple-out press, several chutes are aligned side by side. The press stations may be staggered. The chutes may use the same parts but in different locations.

Figure 5:
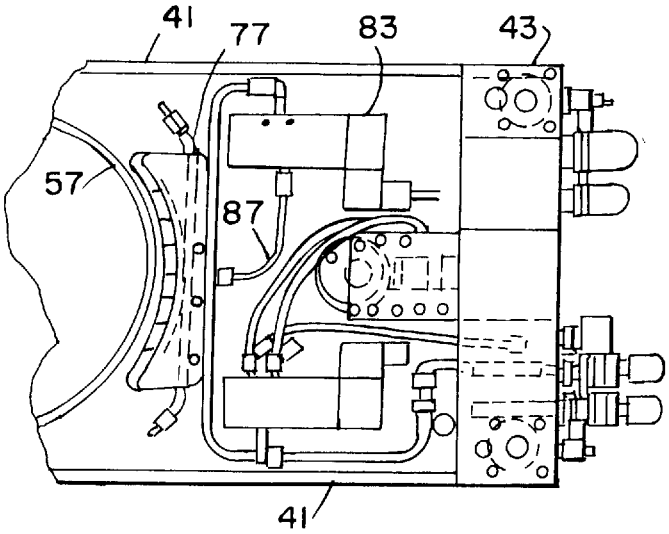
FIG. 5 is a plan view of the front section of the chute.

As shown in FIG. 5, in one modification the curved starter jet assembly 77 is located near the head end 43. The solenoid valve 83 controls air passing through line 87, which is arranged in a different position.

Figure 6:
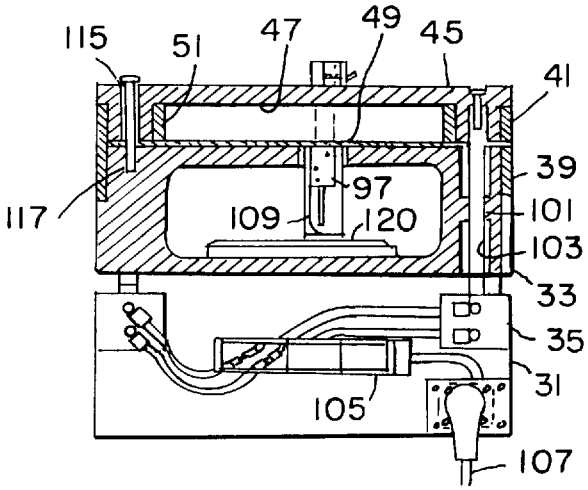
FIG. 6 is a rear elevation view of the chute and a discharge end support, with raising and lowering apparatus shown in partial cross-section.
Figure 7:
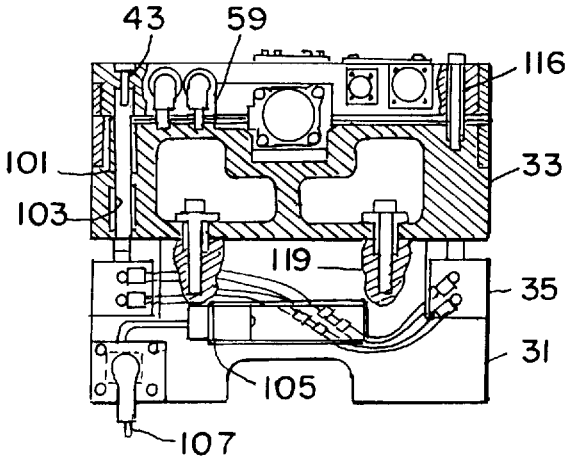
FIG. 7 is a front elevation view and end support for the movable stripper/chute.

FIG. 6 is a detail, partially in cross-section, of chute mount 45 near the discharge end of the chute. The end mount 45 partially surrounds the upper plate 47 and the side members 51 which, together with the bottom wall member 49, form the chute. Support posts 101 are connected to end support 45 and are moved by actuator 35 within linear bearings 103, which are mounted in the guides 33. A solenoid valve 105 applies pressures to the double acting air cylinders, which are the actuators 35, according to control signals from line 107 to lift the chute assembly through head ends 43 and 45. Sensor emitter source 97 is mounted on sensor support 109. The opening 111 through which sensor emitters 97 emit light, and the openings 113 through which the receivers 99 receive the light, may be seen in the side elevation of FIG. 3. Headed pins 115 shown in FIG. 6 retain spring 116 which applies downward pressure on the chute assembly through head ends 43 and 45. As shown in FIG. 7, the head end chute mount 43 has a pair of air sources 59 and an electrical line 107, which controls solenoid valve 105 to supply air selectively to ends of the double-acting cylinders which form the actuators 35. The actuators drive the posts 101 up and down within linear bearings 103 mounted in the guide 33. Bolts 119 secure the guide 33 to the actuator base 31, and when removed allow the chute assembly to slide to the rear out of tang 120 releasing detail 33. The assembly can then be removed for tooling access.

Figure 8:
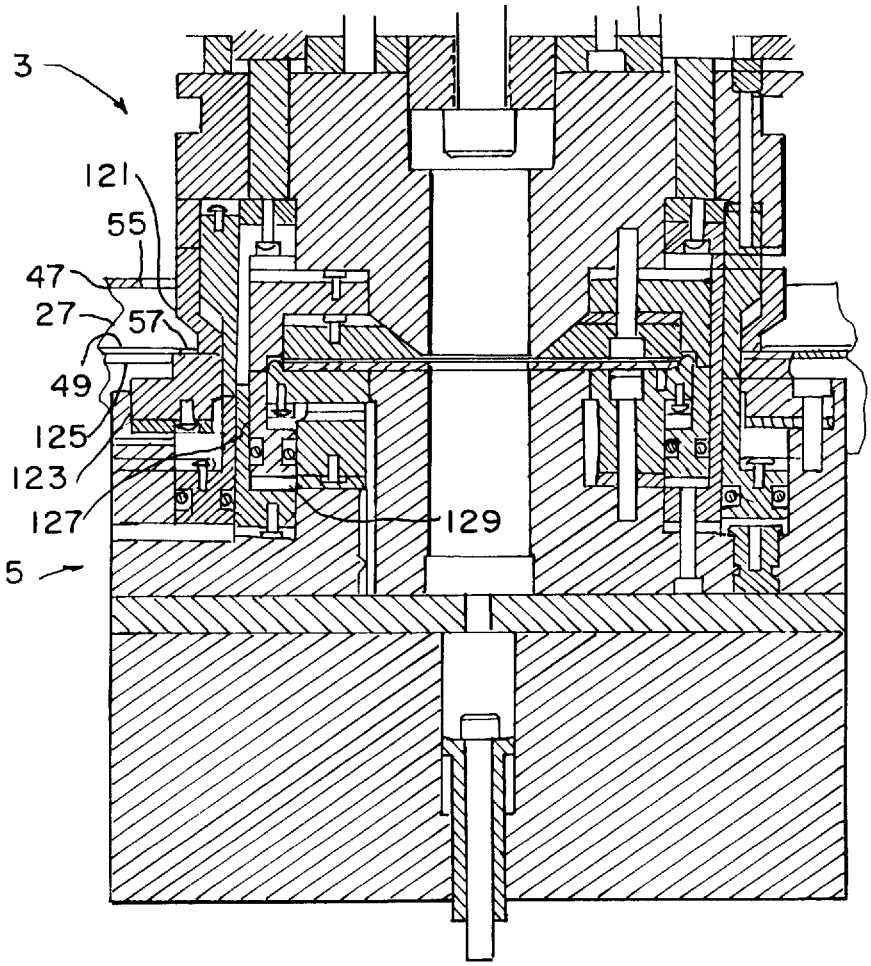
FIG. 8 is a detail of a chute in the lowered position.

FIG. 8 shows the punch assembly 3 and the die assembly 5 in the closed position, with the material stripper 121 gripping the sheet metal against the blanking die 123. The punch assembly 3 extends through the opening 55 in the upper wall 47 of chute 27, and through the opening 57 in the lower wall 49. As can be seen in FIG. 8, the chute 27 is in the lower position which assists in holding the material flat between the lower wall 49 and the surface 125 over which the material moves. The knife edge of the opening 57 aids the removal of the finished can end by air stream. The air stream blows the can end from the surface of the die, and particularly from the top of knockout ring 127 which is raised by fluid pressure in the cavity 129 as the punch is lifted. The can end is lifted above the surface of the die by knockout 127, which engages an annular floor just outside of a reinforcing bead on the can end, and the can end is thereupon carried by the air stream over the knife edge 57 and into the chute 27 prior to lifting chute 27 for material feeding.

Figure 9:
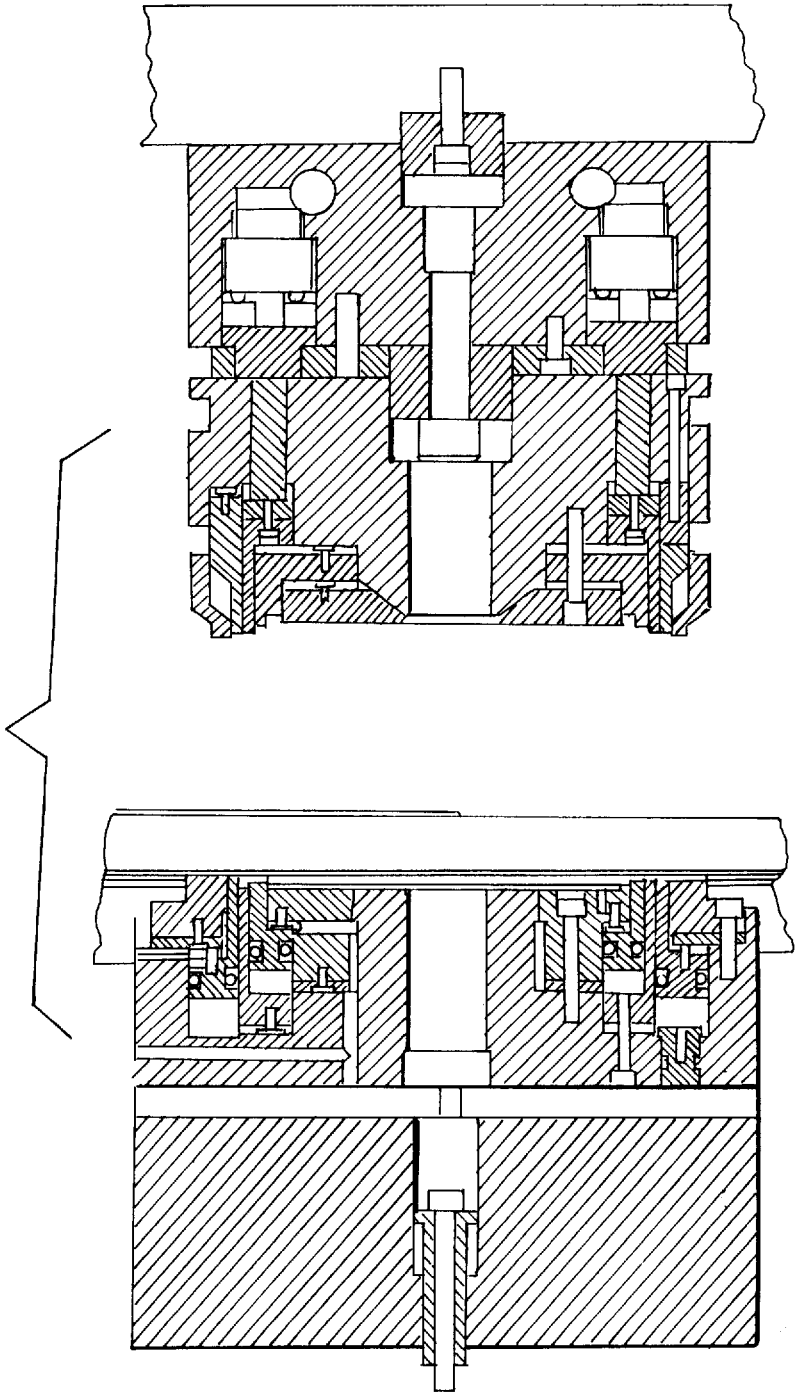
FIG. 9 is a detail of a press with the chute in the raised position.

As shown in FIG. 9, the chute is slightly raised after the can end has been blown into the chute to permit the stepped movement of the sheet material to the next blanking position.

While the invention has been described with reference to specific embodiments, modifications and variations of the invention may be constructed without departing from the scope of the invention, which is defined in the following claims.

We claim:

1. Can end ejection apparatus comprising a chute having a discharge end and upper and lower walls and first and second opposite side walls connected to the upper and lower walls, an opening in the upper wall for receiving a punch and an opening in the lower wall for surrounding a die, the first and second side walls being inwardly tapered beginning at the openings and then being generally parallel with the discharge end of the chute, an air supply connected to the chute and directional air outlets connected to the air supply and to the upper wall of the chute between the openings and the discharge end, an air nozzle connected to the chute upstream of the openings and adjacent the openings for blowing formed can ends across the openings and downstream in the chute through the discharge end, a secondary pressurized air supply connected to the air nozzle for supplying periodic increased flow from the air nozzle, a can end sensor connected to the upper wall downstream of the openings for sensing can ends passing down the chute, a second sensor positioned beneath a lower wall of the chute for cooperating with the first sensor in sensing passage of ends, head end and discharge end mounting blocks respectively attached to a head end and a discharge end of the chute, first and second stripper bases anchored at opposite ends of the chute, first and second guides respectively connected to the bases beneath the head and discharge mounting blocks, fluid actuators connected to the bases, stripper guide posts connected to the fluid actuators and connected to the mounts for raising and lowering the mounts and the chutes, linear bearings mounted in the guides surrounding the guide posts for guiding the guide posts, stripper support rails connected to the mounts for interconnecting the mounts and connected to the chute for supporting the chute, lower guide rails connected to the stripper guides for supporting the guides.

2. Can end ejector chute apparatus comprising first and second chute bases respectively mounted in front of and in back of a press, chute guides mounted on the bases and vertically aligned linear bearings mounted in the chute guides, guide rails extending across the press bed and interconnecting the first and second guides on the first and second bases, double-acting cylinder actuators mounted on the bases and posts connected to the actuators and extending through the linear bearings in the guides, solenoid valves connected to the double-acting cylinder actuators, an air source connected to the solenoid valve and supply lines connected between the solenoid valve and ends of the double-acting cylinders, and an electrical control connected to the solenoid valve for selectively controlling fluid from the source through the valve to the actuators to selectively raise and lower the actuators and the posts, first and second chute mounts connected to the posts for moving vertically with the posts, chute rails connected to the chute mounts and extending parallel to the guide rails for raising and lowering with the guide rails, a chute connected to the chute mounts, the chute having an upper wall, a lower wall and first and second side walls, the upper and lower walls having aligned openings for receiving a reciprocating punch moving cooperatively with a die assembly positioned between the opening in the lower wall, and air nozzles connected to the chute for supplying air downward and rearward toward a discharge end of the chute for entraining can ends along the chute.

3. The apparatus of claim 2, further comprising a curved nozzle positioned adjacent the opening in the lower wall on a side opposite the discharge opening of the chute for directing a curtain of air across the opening in the lower wall of the chute and across the die assembly toward the discharge end of the chute.

4. The apparatus of claim 3, further comprising a source of high pressure air, a solenoid valve connected to the source of high pressure air and having an output connected to the curved nozzle and a control connected to the solenoid valve for opening the solenoid valve and delivering high pressure air to the curved nozzle for starting movement of a can cover end across the opening in the lower wall and across the die assembly.

5. A method of ejecting can ends from upper and lower dies comprising advancing a sheet of material, lowering a chute into contact with the sheet, closing the dies, punching a blank from the sheet, forming a can end from the blank near an opening in a chute, opening the dies, blowing the can end into and along the chute, raising the chute and repeating the steps.

6. The method of claim 5, further comprising lifting the formed can end from the lower dies before the blowing.

7. The method of claim 5, further comprising sensing can ends passing through the chute.

8. The method of claim 5, wherein the blowing comprises directing air in a parallel stream from a curved nozzle adjacent the opening and turning off air when the can end is clear of a sensor.

9. The method of claim 5, wherein the blowing further comprises directing air streams rearward and downward into the chute from multiple nozzles at the top of the chute.

10. The method of claim 7, wherein the sensing comprises emitting a beam below the chute, sending the beam through aligned openings in a bottom and a top of the chute, and detecting the beam and interruptions in the beam at the top of the chute.

* * * * *